US007966733B2

(12) United States Patent
Jun

(10) Patent No.: US 7,966,733 B2
(45) Date of Patent: Jun. 28, 2011

(54) SCISSORS WITH A RINGLET

(76) Inventor: Dong Ho Jun, Santa Ana, CA (US)

( * ) Notice: Subject to any disclaimer, the term of this patent is extended or adjusted under 35 U.S.C. 154(b) by 216 days.

(21) Appl. No.: 11/655,560

(22) Filed: Jan. 19, 2007

(65) Prior Publication Data

US 2008/0172886 A1 Jul. 24, 2008

(51) Int. Cl.
*B26B 13/00* (2006.01)
*B25G 1/00* (2006.01)

(52) U.S. Cl. ..... 30/232; 30/254; 30/341

(58) Field of Classification Search ..... 30/254, 30/257, 260, 271, 341, 232; D8/57
See application file for complete search history.

(56) References Cited

U.S. PATENT DOCUMENTS

| | | | | | |
|---|---|---|---|---|---|
| 242,000 | A | * | 5/1881 | Klaucke | 30/341 |
| 328,813 | A | * | 10/1885 | Röder | 30/271 |
| 430,677 | A | * | 6/1890 | Pearsall | 30/341 |
| 440,436 | A | * | 11/1890 | Pearsall | 30/341 |
| 486,083 | A | * | 11/1892 | Clark | 30/341 |
| 590,330 | A | * | 9/1897 | Nolen | 30/254 |
| 753,919 | A | * | 3/1904 | Rowe | 30/260 |
| 848,966 | A | * | 4/1907 | Carlson | 30/341 |
| 920,092 | A | * | 4/1909 | Slaughter | 30/341 |
| 927,058 | A | * | 7/1909 | Krouse | 30/341 |
| 1,479,908 | A | * | 1/1924 | Goshia | 30/341 |
| 1,623,130 | A | * | 4/1927 | Otis | 30/271 |
| 2,158,277 | A | * | 5/1939 | Dolph | 30/341 |
| 2,380,075 | A | * | 7/1945 | Rose | 30/341 |
| 2,571,675 | A | * | 10/1951 | Bray | 30/341 |
| 2,575,861 | A | * | 11/1951 | Bray | 30/341 |
| 3,894,336 | A | * | 7/1975 | Desimone | 30/341 |
| 3,906,630 | A | * | 9/1975 | Megna | D8/57 |
| 3,974,563 | A | * | 8/1976 | Koch | 30/341 |
| 3,978,584 | A | * | 9/1976 | Mayer | D8/57 |
| 4,146,961 | A | * | 4/1979 | Pinto | 30/341 |
| 4,184,249 | A | * | 1/1980 | Megna et al. | 30/341 |
| 4,254,551 | A | * | 3/1981 | Megna et al. | 30/341 |
| 4,345,378 | A | * | 8/1982 | Pracht | 30/270 |
| 4,642,895 | A | * | 2/1987 | Gauvry | 30/341 |
| 4,742,617 | A | * | 5/1988 | Gauvry | 30/341 |
| 5,109,608 | A | * | 5/1992 | Pracht | 30/341 |
| 5,125,159 | A | * | 6/1992 | Brenton et al. | 30/341 |
| 5,301,430 | A | * | 4/1994 | Brenton et al. | 30/341 |
| 5,469,624 | A | * | 11/1995 | Brenton et al. | 30/232 |
| 5,781,999 | A | * | 7/1998 | Chang | 30/341 |
| 6,249,977 | B1 | * | 6/2001 | Knoop | 30/341 |
| 6,739,057 | B2 | * | 5/2004 | Schallenberg | 30/341 |
| D536,941 | S | * | 2/2007 | Nenadich et al. | D8/57 |
| D537,312 | S | * | 2/2007 | Nenadich et al. | D8/57 |
| D538,612 | S | * | 3/2007 | Nenadich et al. | D8/57 |
| 7,424,778 | B2 | * | 9/2008 | Brenton | 30/341 |

(Continued)

FOREIGN PATENT DOCUMENTS

DE 3928859 A1 * 3/1991

*Primary Examiner* — Jason Daniel Prone

(57) ABSTRACT

A pair of scissors equipped with a three axially pivoting ringlet is presented. The ringlet of the scissors according to current application is comprised of flexible NBR (Acrylonitrile Butadiene Rubber). The ringlet is attached to one handle of the scissors of the current application to provide a thumb's insert, thereby providing proper fit to the user's fingers due to the flexibility of the NBR. The ringlet is attached to the thumb portion of one handle of the scissors via a part that enables the ringlet to rotate in two independent directions and to pivot around one axis that is parallel to handle.

1 Claim, 5 Drawing Sheets

U.S. PATENT DOCUMENTS

| | | | | |
|---|---|---|---|---|
| D612,696 | S * | 3/2010 | Iwase | D8/57 |
| 2002/0129497 | A1 * | 9/2002 | Lyddon et al. | 30/341 |
| 2004/0211068 | A1 * | 10/2004 | Yusufov et al. | 30/341 |
| 2005/0005456 | A1 * | 1/2005 | Wang et al. | 30/341 |
| 2005/0204569 | A1 * | 9/2005 | Brenton | 30/323 |
| 2006/0010695 | A1 * | 1/2006 | Wu | 30/254 |
| 2010/0242289 | A1 * | 9/2010 | Roskam et al. | 30/341 |

* cited by examiner

SCISSORS WITH A RINGLET

FIELD OF THE INVENTION

The current application relates to scissors, specifically related to scissors that are equipped with a three axially pivoting ringlet.

BACKGROUND OF THE INVENTION

Barbers, hair dressers, tailors, surgeons and gardeners all use scissors as a main tool. Gardeners use scissors that are designed to maximize force when cutting branches of a plant. Other than a gardener's scissors, the other scissors are very similar. Among those who use scissors as a main tool, barbers use them most frequently. In addition, they must use their scissors in various positions for the comfort of their customer. As a result, a barber must sacrifice his or her own comfort in handling the scissors. After years of practicing as a barber, most of them suffer from arthritis in their thumbs and index fingers. Most barbers believe that the inconvenient grip of the scissors cause the arthritis in their fingers. Scissors that are equipped with flexible and rotating ringlets for fingers have been introduced. However, most of them do not provide full convenience to the barbers due to the limitation of the rotation and flexibility of the ringlets. It is the purpose of the current application to provide scissors that will provide full convenience to barbers by equipping scissors with a ringlet that will rotate and bend in every direction. In addition, it is another purpose of the current application to provide scissors equipped with a ringlet that fits any finger irrespective of the shape and size of the finger.

DESCRIPTION OF THE PRIOR ART

U.S. Pat. No. 5,125,159 to Brenton, et al. illustrates scissors equipped with an interchangeable finger and thumb ringlet. Flexible ringlets having various sizes are attached to the handle portions of such instruments, thereby providing proper fit to the user's fingers. The ringlets only rotate in two directions.

U.S. Pat. No. 4,742,617 to Gauvry illustrates scissors having an obliquely oriented thumb loop. The thumb loop is oriented approximately 45 degrees downward and 45 degrees laterally with respect to the axis of the handle to which it is attached. The thumb loop also allows for flexible rotational movement of approximately 45 degrees, and flexible vertical movement of approximately 45 degrees. The loop is held in position by a flexible connecting member having a flexible intermediate section that allows for the desired movement as well as the return of the thumb loop to a steady state position upon release.

U.S. Pat. No. 4,642,895 to Gauvry illustrates scissors including a thumb loop means interconnected with respect to the handle of the second member by way of a ball and socket interconnection allowing free movement longitudinally along and perpendicularly around the axis of the second handle. Also, a tab means is included to limit the rotational movement of the thumb loop means about the ball within the socket itself. The finger loop, not for the thumb, includes removable O-ring means to allow for various size fingers of users. The thumb ringlet of the scissors is made of solid material and has limited rotation.

U.S. Pat. No. 4,254,551 to Megna, et al. illustrates scissors comprised of a movable blade pivotally connected to a stationary blade with a finger bow arranged on the respective stock portions of the blades. The finger bow arranged on the movable blade is made of synthetic or similar material and is mounted in an outwardly open opening at the rearward end of the said scissors blade. It has only two directional degrees of freedom.

U.S. Pat. No. 2,640,264 to Sullivan, et al., illustrates scissors with a ringlet, which is equipped with a thumb guide, positioned on one of the handles thereof. The ringlet is comprised of one external ring and one internal ring. The thumb guide rotates freely with the internal ring and the ringlet rotates along the axis of the handle for the thumb. It has only two directional degrees of freedom.

U.S. Pat. No. 1,108,572 to Gordon illustrates cherry clipping scissors, which has a thumb piece pivotally rotating at the end of a first handle of the scissors. It has only one directional degree of freedom.

U.S. Pat. Nos. 440,436 and 430,677 to Pearsall illustrate shears, which have a thumb support hinged at the end of a shank. It has one directional degree of freedom.

None of the prior art illustrates scissors that enables directional freedom for a thumb ringlet in three directions while also providing a fit for various thumb shapes.

SUMMARY OF THE INVENTION

Barbers, hair dressers, tailors, surgeons and gardeners all use scissors as a main tool. Gardeners use scissors that are designed to maximize force when cutting branches of a plant. Other than a gardener's scissors, the other scissors are very similar. Among those who use scissors as a main tool, barbers use them most frequently. In addition, they must use their scissors in various positions for the comfort of their customer. As a result, a barber must sacrifice his or her own comfort in handling the scissors. After years of practicing as a barber, most of them suffer from arthritis in their thumbs and index fingers. Most barbers believe that the inconvenient grip of the scissors cause the arthritis in their fingers. Scissors that are equipped with flexible and rotating ringlets for fingers have been introduced. However, most of them do not provide full convenience to the barbers due to the limitation of the rotation and flexibility of the ringlets. It is the purpose of the current application to provide scissors that will provide full convenience to barbers by equipping scissors with a ringlet that will rotate and bend in every direction. In addition, it is another purpose of the current application to provide scissors equipped with a ringlet that fits any finger irrespective of the shape and size of the finger.

DETAILED DESCRIPTION OF THE PREFERRED EMBODIMENT

Figure 1:
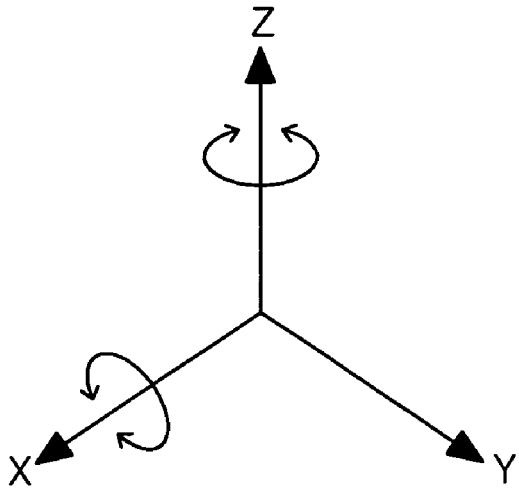
Fig. 1 Prior Art
FIG. 1 is a schematic drawing of the directional degree of freedom of the first example of the prior arts.

FIG. 1 is a schematic drawing of directional degree of freedom of one example of the prior arts, U.S. Pat. No. 5,125, 159 to Brenton, et at. In FIG. 1, the X axis is an axis parallel to the handle of the scissor. The Y axis is an axis that is perpendicular to a plane that is formed by two blades of the scissors. The Z axis is an axis that is perpendicular to the X axis and the Y axis.

According to Brenton, the ringlet 18 is attached to extension 16 and is constructed from flexible materials so that additional motion is available to an inserted digit of the user of the device. A handle extension 16 including a tubular section 46 is located at the terminus thereof having its axis disposed in a substantially perpendicular manner to the axis of the handle extension and adapted to receive the ringlet 18. Handle extension 16 has a hole 48 bored along the axis thereof in order to enable it to receive the reduced diameter terminus 32 of the scissors handle 14 to which it is rigidly attached.

Therefore, the ringlet 18 of '159 rotates freely around the Z axis and X axis of FIG. 1. Slight movement around the Y axis may be possible. But, every movement around the Y axis provides a stress strain to the ringlet 18. Since the ringlet 18 is constructed from flexible materials, repeated stress strain applied to the ringlet 18 will deteriorate the physical property of the material and it will eventually break down. If this happens while cutting a customer's hair, it may cause serious damage to the customer.

Figure 2:
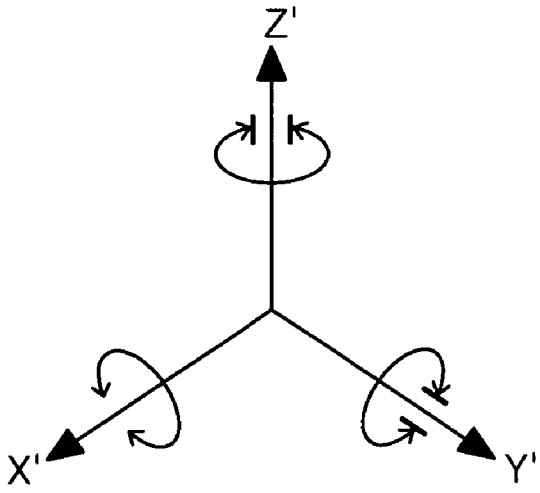
Fig. 2 Prior Art
FIG. 2 is a schematic drawing of the directional degree of freedom of the second example of the prior arts.

FIG. 2 is a schematic drawing of directional degree of freedom of second example of the prior arts, U.S. Pat. No. 4,642,895 to Gauvry. In FIG. 2, the X' axis is an axis parallel to the handle of the scissors. The Y' axis is an axis that is perpendicular to a plane that is formed by two blades of the scissors. The Z' axis is an axis that is perpendicular to the X' axis and the Y' axis.

According to Gauvry, a thumb loop means 28 is mounted on a second handle means 22 by way of a movable interconnecting means 36. It takes the form of a ball means 38 which is fixedly secured with respect to the thumb loop means 28 and a socket means 40 defined within the second handle means 22.

A tap means 50 is positioned therein extending downwardly from the thumb loop means 50 to restrict rotation of the thumb loop.

Therefore, the thumb loop means 28 of '895 rotates freely only around the X' axis of FIG. 2. The tap means 50 not only restricts the rotation of the thumb loop means 28 around the Z' axis but also around the Y' axis due to the long tail of the tap means 50.

Figure 3:
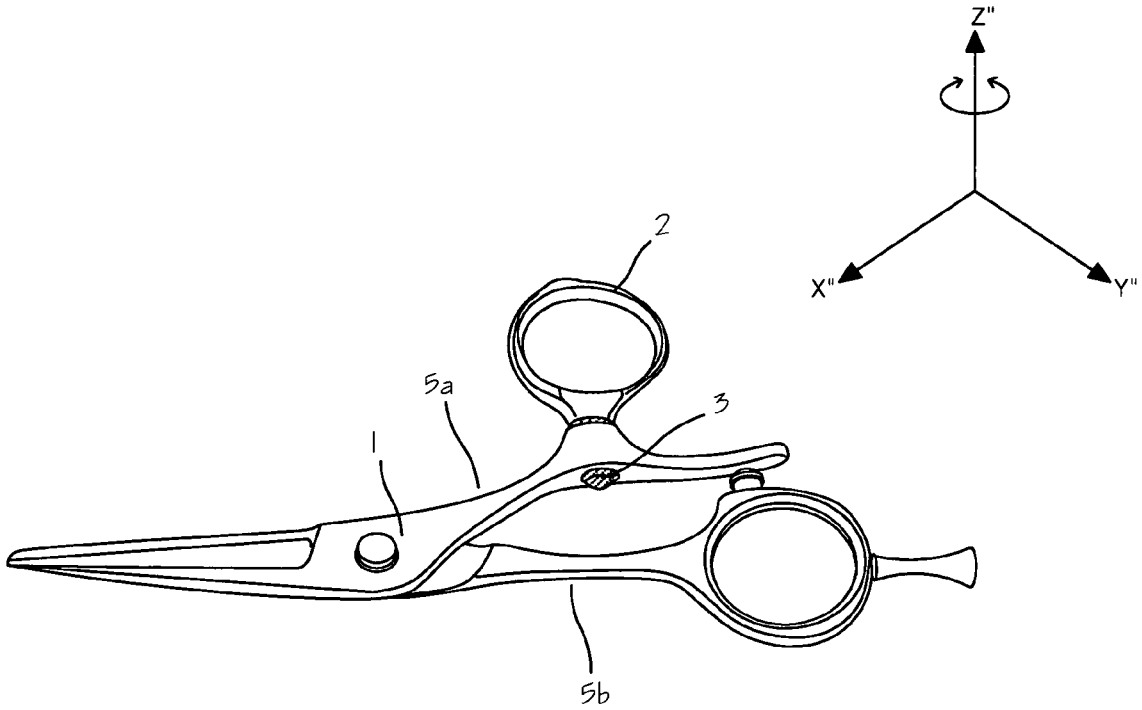
Fig. 3 Prior Art
FIG. 3 is a perspective view of third example of the prior arts and a schematic drawing of the directional degree of freedom thereof.

FIG. 3 is a perspective view of the third example of the prior arts and a schematic drawing of directional degree of freedom thereof. In, FIG. 3, X" axis is an axis parallel to the handle of the scissor. Y" axis is an axis that is perpendicular to a plane that is formed by two blades of the scissors. Z" axis is an axis that is perpendicular to the X" axis and the Y" axis. The third example is a popular product on market. The pair of scissors of the third example is comprised of a main body (1) and a ringlet (2).

The ringlet (2) is rotatably connected to a handle (5*a*) of the scissor via a connecting means (3). The ringlet (2) of the scissor in FIG. 3 rotates freely only around the Z" axis.

Figure 4:
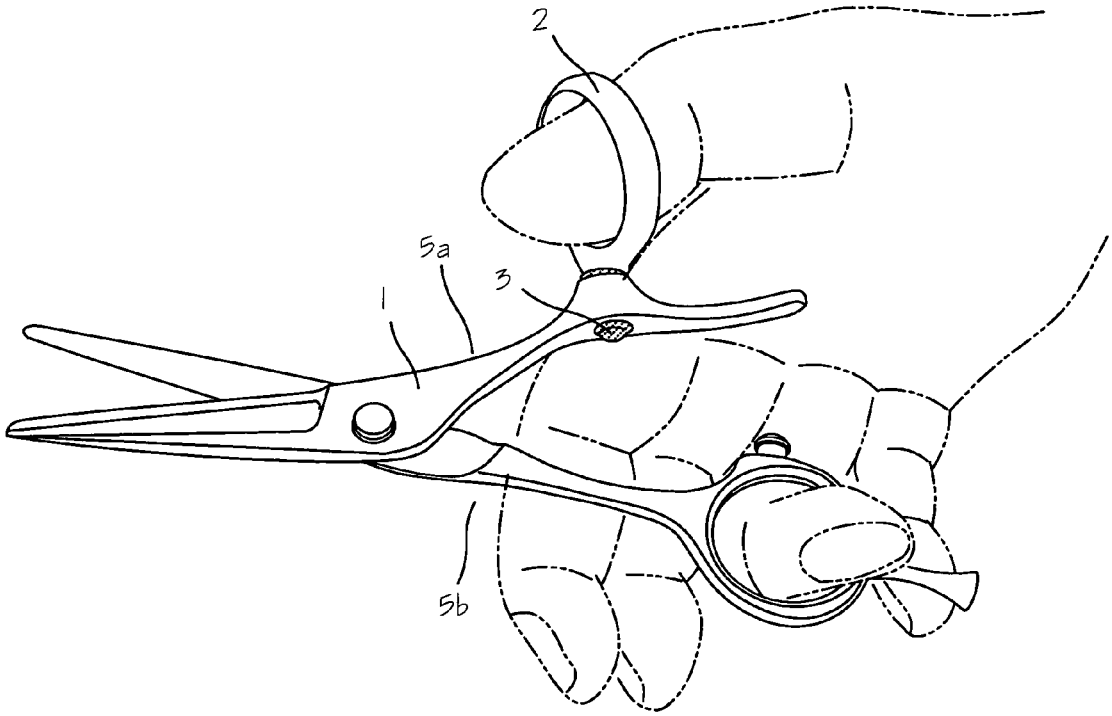
Fig. 4 Prior Art
FIG. 4 is a schematic drawing showing how the third example of the prior arts is used.

FIG. 4. is a schematic drawing showing how the third example of the prior arts is used. The thumb of a user is engaged to the ringlet (2).

Figure 5:
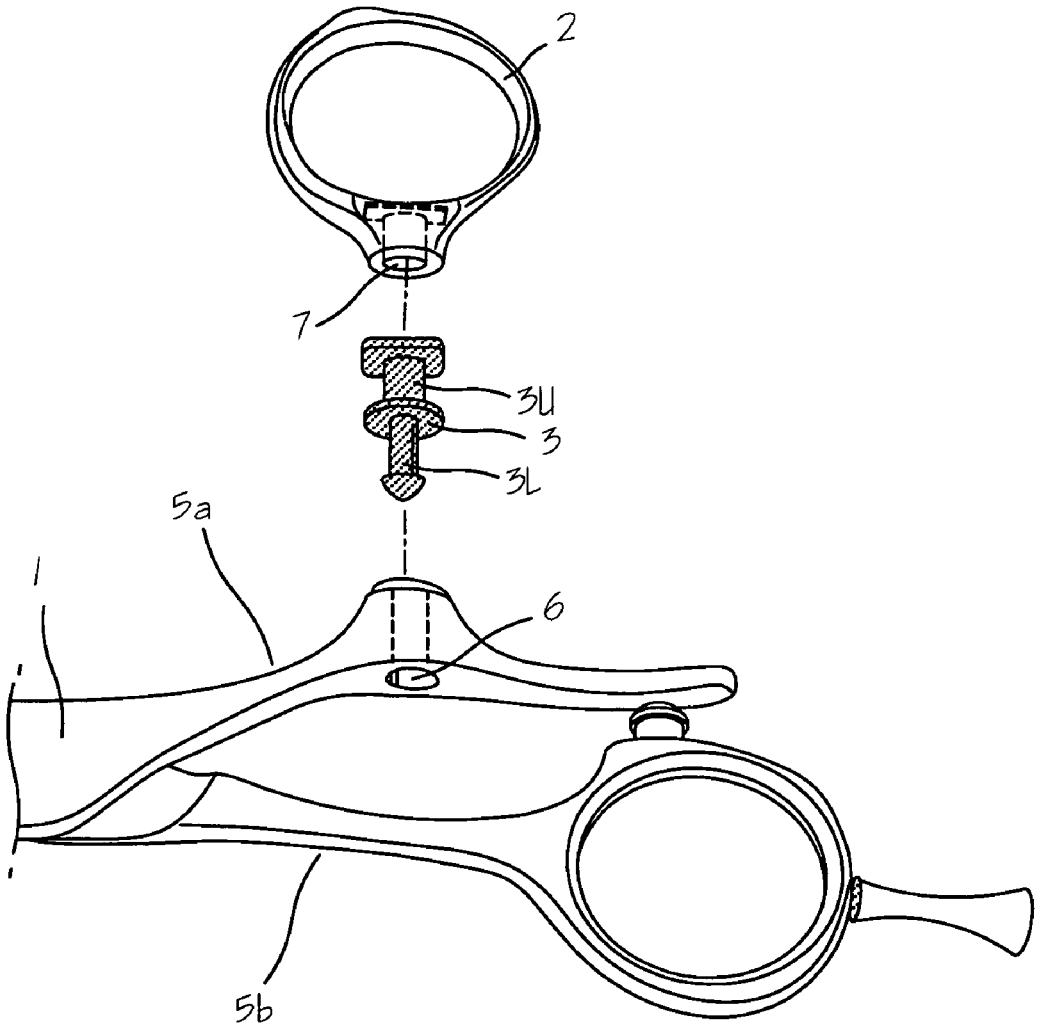
Fig. 5 Prior Art
FIG. 5 is an exploded view of a connecting means between the scissors handle and ringlet for the third example of the prior arts.

FIG. 5 is an exploded view of a connecting means (3) for the third example of the prior arts that rotatably connects the scissors' handle (5*a*) and ringlet (2). The connecting means (3) is made of a rubbery material. The connecting means (3) has an upper section (3U) and a lower section (3L). The upper section (3U) of the connecting means (3) is engaged to a bore (7) developed on the lower bottom of the ringlet (2) and the lower section (3L) of the connecting mean is engaged to a hole (6) developed on a handle (5*a*) of the scissor.

Since the ringlet (2) of the third example can rotate freely only around the Z" axis of the FIG. 3, the inventor tries to give some flexibility by applying a rubbery material to the connecting means (3). However, it is well known that repeated stress to a rubbery material deteriorates physical properties. Therefore, the same danger of cutting the customer's head or skin remains as explained in the first example.

Figure 6:
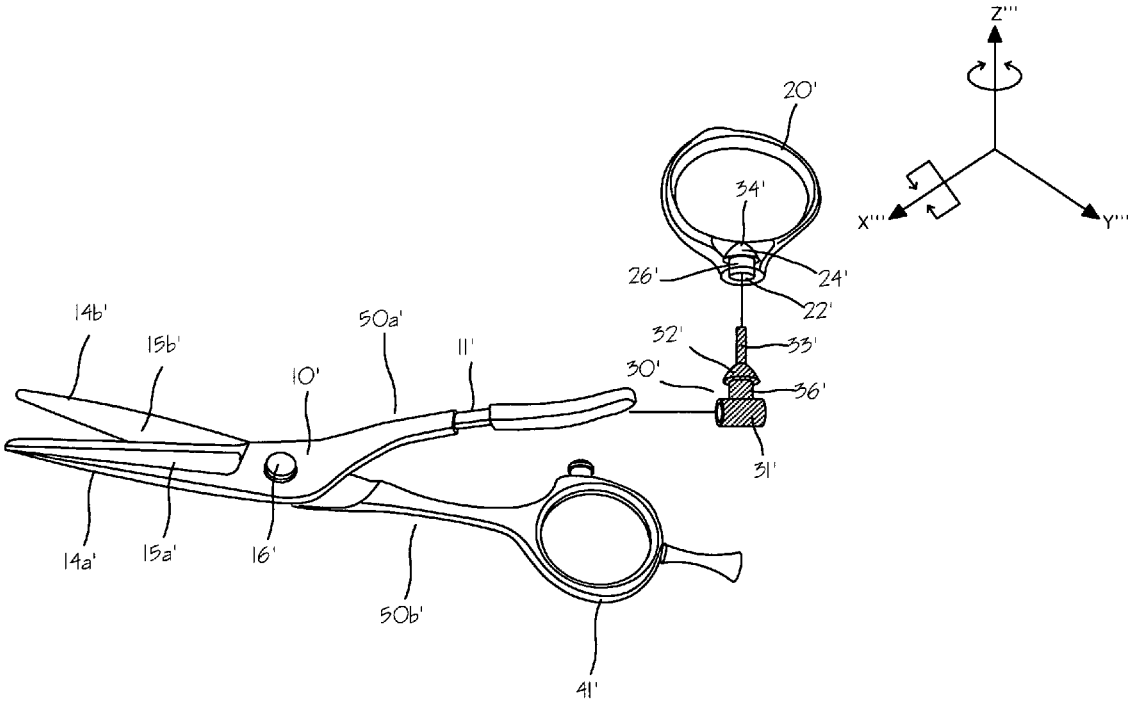
FIG. 6 is a perspective view of a pair of scissors combined with an exploded view of a ringlet and a connecting part for the pair of scissors according to preferred embodiment of the current application.

FIG. 6 is a perspective view of a pair of scissors (10') combined with an exploded view of a ringlet (20') and a connecting part (30') for a scissors according to the embodiment of the current application. The scissors (10') according to the current application is comprised of a first shank member (14*a*') including a first cutting portion (15*a*') and a first handle portion (50*a*'), and second shank member (14*b*') including a first cutting portion (15*a*') and a first handle portion (50*a*'), and second shank member (14*b*') including a second cutting portion (15*b*') and a second handle portion (50*b*'). The first shank member (14*a*') and second shank member (14*b*') are pivotally connected to each other via screw (16'). The second handle portion (50*b*') has a solid ringlet (41'). A flexible ringlet (20') is rotatably connected to the first handle portion (50*a*') via a connecting part (30') that is engaged to a narrow portion (11') of the first handle portion (50*a*'). The ringlet (20') is comprised of a flexible material. A bore (22') is developed at the bottom of the ringlet (20') for insertion of the connecting part (30'). The bore (22') is in the shape of a cone (24') on a cylindrical rod (26') and a hole (34') is developed at the top of the bore (22').

The connecting part (30') is comprised of a top portion consisting of a cone (32') on a cylindrical rod (36') and an extension (33'), to aid the insertion of the top portion (32') into the bore (22'), and a bottom portion consisting of a tube (31'). The tube (31') is engaged on the narrow portion (11') of the first handle portion (50*a*').

What is claimed is:

1. A pair of scissors with a removable and flexible ringlet comprising:

a first shank member having a first cutting portion and a first handle portion, wherein the first handle portion has a narrow portion;

a second shank member having a second cutting portion and a second handle portion, wherein the second shank member is pivotally connected to the first shank member;

a connecting part incorporating an upper part and a lower part, the upper part includes a cone-shaped portion, a cylindrical-shaped portion, and an extension portion extending from the cone-shaped portion, the lower part includes a tube portion, wherein the tube portion receives the narrow portion of the first handle; and the ringlet incorporates a finger hole and a through bore configured to receive the connecting part, wherein the extension portion of the connecting part aids in the insertion of the connecting part into the through bore, a first part of the through bore is shaped to receive and correspond to the cone-shaped portion of the connecting part and a second part of the through bore is shaped to receive and correspond to the cylindrical-shaped portion of the connecting part.

* * * * *